United States Patent [19]

Diepeveen

[11] 4,181,827

[45] Jan. 1, 1980

[54] JOY STICK SWITCH

[76] Inventor: John C. Diepeveen, 1737 Kimberly Dr., Sunnyvale, Calif. 94086

[21] Appl. No.: 926,789

[22] Filed: Jul. 21, 1978

[51] Int. Cl.[2] ..... H01H 25/04

[52] U.S. Cl. ..... 200/6 A; 200/17 R; 200/153 T; 200/332

[58] Field of Search ..... 200/5 R, 6 A, 17 R, 200/18, 153 K, 153 T, 291, 290, 330–332; 74/471

[56] References Cited

U.S. PATENT DOCUMENTS

| | | | |
|---|---|---|---|
| 2,391,881 | 1/1946 | Clay | 200/6 A X |
| 2,397,978 | 4/1946 | Paulus et al. | 200/6 A |
| 2,679,678 | 6/1954 | Stephan | 200/6 A |
| 2,754,411 | 7/1956 | Dohrmann | 200/6 A |
| 2,841,659 | 7/1958 | Eitel | 200/6 A X |
| 2,984,720 | 5/1961 | Fisher | 200/332 X |
| 3,115,555 | 12/1963 | Lescarboura | 200/153 T X |
| 3,599,669 | 8/1971 | Polzer | 200/153 T X |
| 3,708,636 | 1/1973 | Sobchak | 200/291 X |

FOREIGN PATENT DOCUMENTS

| | | | |
|---|---|---|---|
| 1225738 | 9/1966 | Fed. Rep. of Germany | 200/153 T |

*Primary Examiner*—James R. Scott

*Attorney, Agent, or Firm*—Townsend and Townsend

[57] ABSTRACT

An electrical control device having a joystick operator normally biased to a central position by resiliently biased rigid strips secured to a base plate. The joystick operator is pivoted in anyone of a plurality of directions through a 360° arc. No more than two electrical switches or actuatable devices can be operated simultaneously by the joystick operator. The rigid strips are resiliently biased by either the internal springs of the actuator elements of respective switches or by springs externally of the switches. Movement of the strip causes depression of the associated switch actuator element. When the joystick operator is released, its shaft is returned to an equilibrium position.

11 Claims, 3 Drawing Figures

JOY STICK SWITCH

This invention relates to improvements in electrical control devices for operating such things as X–Y translating mechanisms and, more particularly, to an improved joy stick switch.

BACKGROUND OF THE INVENTION

Semiconductor wire bonders, such as thermocompression or ultrasonic bonders, generally use an X–Y translating mechanism having a platform which supports a semiconductor chip and moves the same relative to and below the bonding tool of the bonder so that electrical lead wires can be connected to the chip at various locations thereon. Such a translating mechanism is operated by two motors, one motor for driving the platform back and forth along one line and the second motor being used to move the platform back and forth along a second line perpendicular to the first line.

The control means for operating the motors generally comprises a shiftable joy stick manipulated by one hand of the machine operator as the operator views the work area of the chip through a microscope. Conventional joy stick devices for this purpose have been quite complicated in construction and have used potentiometers for varying the voltages applied to the motors so that the motors stop and go as a function of the change of resistance of the potentiometers. Because of the complex nature of conventional joy stick devices, they are costly to produce and assemble and oftentimes must be repaired or replaced due to faults in the parts thereof. Because of this drawback, a need has arisen for an improved joy stick control device which is simple and rugged in construction and can be made at relatively low cost yet is simple to operate and is readily adapted for use on bonders of the type described.

SUMMARY OF THE INVENTION

The present invention satisfies the aforesaid need by providing a joy stick control device which operates as a multiswitch unit capable of actuating a pair of power members, such as electrical motors, individually or simultaneously so that the device is suitable for use in driving an X–Y translation mechanism of a wire bonder of the type described. To this end, the device of the present invention includes a base plate having a hole there through and a shaft extending through the hole, the shaft having a ball joint intermediate its ends for pivotally coupling it to the base plate for pivotal movement in 360°. A number of spaced electronic switches are arranged on the base plate in an array surrounding the shaft, and each switch has a spring-biased, push-button actuator element projecting laterally therefrom which, when depressed, actuates the switch.

A number of generally rigid bars or strips are pivotally mounted on the base plate, there being a strip for each shaft respectively. Each strip normally engages or is in proximity to both the outer end of the plunger element of the corresponding switch and a boss on the adjacent portion of the shaft when the shaft is in its equilibrium position, i.e., when the switches are not actuated. The strips are biased toward the shaft and against stop pins also carried on the base plate. By pivoting the shaft relative to the base plate, one or two of the switches can be actuated depending upon the direction of movement of the shaft. Upon release of the shaft, the shaft returns to its equilibrium position under the influence of the spring means which can be either the internal springs associated with the actuator elements of the switches or springs external to the switches.

The device of the present invention is simple in construction and the switches on the base plate thereof are accessible so that the switches can be quickly and easily replaced, if defective, without disrupting the entire assembly or requiring complete disassembly of the device. The device takes up a minimum of space; thus, it can be quickly and easily mounted in place as a replacement for a conventional joy stick device.

The primary object of this invention is to provide an improved joy stick switch which is simple and rugged in construction, is inexpensive to produce and maintain, and can be used as a replacement part for a conventional joy stick device of a semiconductor wire bonding apparatus.

Another object of this invention is to provide a device of the type described wherein a pivotal shaft on a base plate operates to shift any one or a pair of a number of rigid strips also pivotally mounted on the base plate so that the strips will move actuator elements on respective electrical switches carried by the base plate to actuate the switches individually or simultaneously to provide circuit enabling action in a simple manner without the requirement for complicated structure as is required in conventional devices of this type.

Other objects of this invention will become apparent as the following specification progresses, reference being had to the accompanying drawings for an illustration of several embodiments of the invention.

Figure 1:
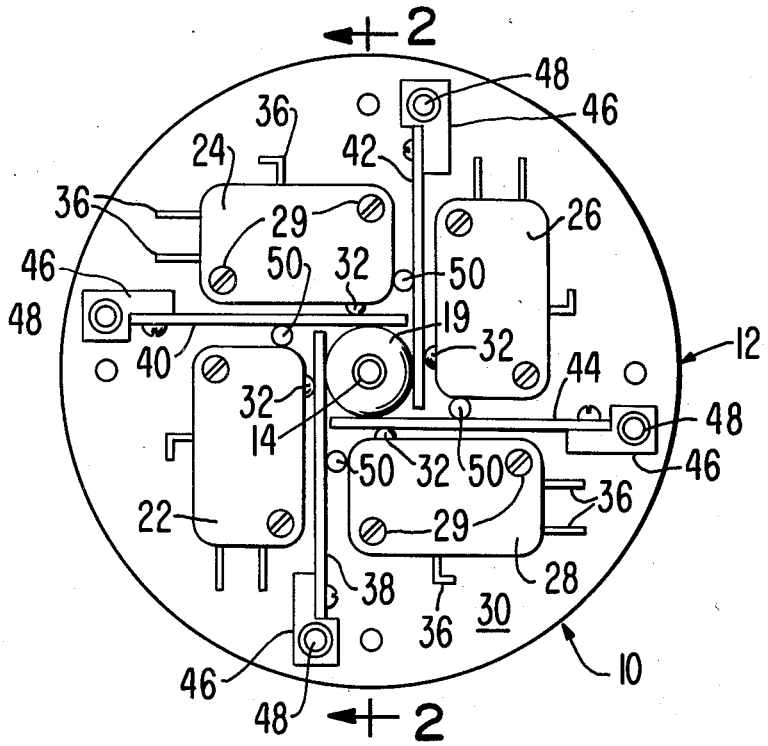
FIG. 1 is a bottom plan view of a first embodiment of a control device of this invention.

The control device of this invention is broadly denoted by the numeral 10 and is in the nature of a joy stick switch having a base plate 12, and a shaft 14 extending through a central hole 21 in the base plate. The shaft is provided with a ball joint 16 pivotally mounted in a retainer ring 18 carried by base plate 12 so that shaft 14 can pivot in all directions about axes extending through ball joint 16 and ring 18. One end of shaft 14 has a knob 20 which is manually grasped to shift the shaft. The opposite end of the shaft has a boss 19 thereon.

The device 10 further includes a group of electrical switches 22,24,26 and 28 which are grouped in an array about boss 19 of the shaft and are rigidly secured, such as by screws 29 to the bottom flat face 30 of base plate 12. Each of these switches is in the form of a microswitch having a spring-biased actuator or plunger element 32 projecting laterally from one side of the switch housing. Each switch has spaced terminals 36 for making electrical connection with leads directed to other circuitry, such as to a pair of motors of an X–Y translating mechanism.

Figure 2:
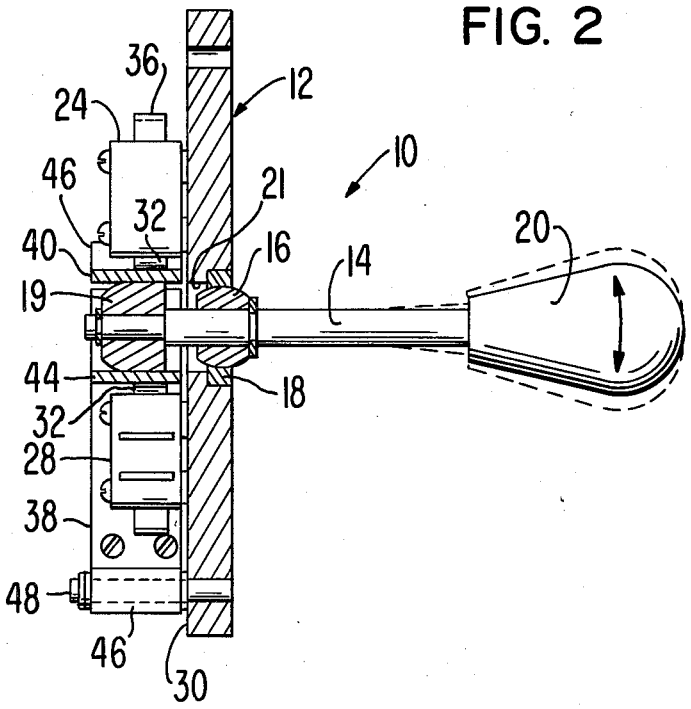
FIG. 2 is a cross-sectional view taken along line 2—2 of FIG. 1.

A rigid, rectangular strip is provided for each switch, respectively, the strips being denoted by the numerals 38,40,42 and 44. Each strip has a bracket 46 secured to one end thereof and the bracket is pivotally mounted on a pin 48 secured to and extending outwardly from face 30 of base plate 12, pins 48 being generally parallel with shaft 14 when the latter is in the equilibrium position thereof shown in FIG. 2. Thus, the strips 38,40, 42 and 44 can pivot independently of each other about the axes of respective pins 48.

Pins 48 are located so that the ends of respective strips remote from pins 48 are between boss 19 and the corresponding actuator elements 32 of respective switches. The switches have springs (not shown) in the respective housings thereof, and these springs force respective plunger elements 32 outwardly so that the plunger elements bear against and bias the adjacent strips toward and into engagement with corresponding stop pins 50 which are secured to and extend laterally from face 30 and are parallel with pins 48. The locations of the actuator elements 32, the strips 38–44, and boss 19 are such that, when the boss is in its equilibrium position in which shaft 14 is perpendicular to the plane of plate 12 (FIG. 2), all of the strips engage or are in proximity to the boss in the manner shown in FIG. 1 as the strips engage pins 50. When shaft 14 is pivoted in any direction, it will move either one or two of the strips, depending upon the direction of movement of the shaft, thereby actuating the respective switch or switches to enable the circuitry connected to such switch or switches.

In use, base plate 12 is typically secured to a rigid support with shaft 14 extending upwardly from the base plate. Connections are made to the terminals 36 of the various switches and the device 10 is then operable to actuate the switches by manipulation of shaft 14.

Device 10 is suitable for a number of different uses but, specifically, it can be used to form a part of a semiconductor wire bonding apparatus of the type having an X-Y translating mechanism for supporting and moving a semiconductor chip to which wire leads are to be bonded. In such a case, shifting of shaft 14 in various directions will successively actuate one or more of the switches 22,24,26 and 28. For instance, if shaft 14 is shifted so that boss 19 moves in a direction toward the 9 o'clock position when viewing FIG. 1, strip 38 will pivot in a counterclockwise direction and will depress actuator element 32 of switch 22 to thereby actuate the switch. The other switches will remain unactuated.

As another example, shaft 14 can be shifted to move boss 19 toward the 11 o'clock position when viewing FIG. 1. This will simultaneously pivot strips 38 and 40 in a counterclockwise direction about their respective pins 48, causing simultaneous actuation of switches 22 and 24, leaving switches 26 and 28 unactuated. Other movements of shaft 14 can be made so that one or both of switches 26 and 28 can be actuated. In its present form, device 10 is operable such that only, at most, two of the four switches can be simultaneously actuated and, if two switches are simultaneously actuated, they must be adjacent to each other, e.g., switches 24 and 26, or switches 22 and 28. Simultaneous actuation of two switches corresponds to translating an X-Y mechanism in a diagonal direction rather than having to go first in one direction, such as toward the 9 o'clock position, and then in another direction, such as toward the 12 o'clock position.

Figure 3:
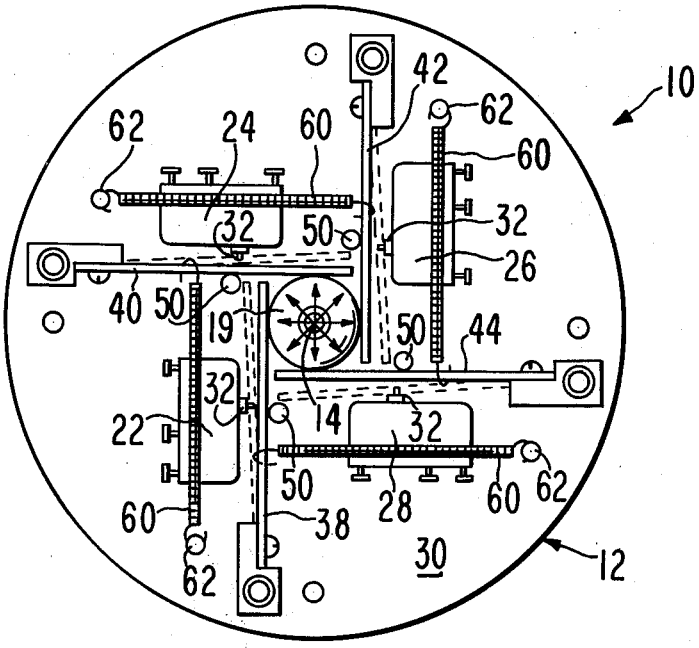
FIG. 3 is a view similar to FIG. 1 but showing a second embodiment of the control device.

FIG. 3 shows a slightly different embodiment of device 10. The only difference in the FIG. 3 embodiment is the use of external springs 60 for biasing respective strips 38,40,42 and 44 against the corresponding stop pins 50. Springs 60 are used in the event that the actuator springs inside the housings of the various switches are not strong enough to bias the respective strips 38–44 against their stop pins 50.

Each spring 60 is hooked at one end through a hole in the corresponding strip and hooked at the other end through a hole in a corresponding pin 62 secured to and projecting laterally from face 30 and parallel to pins 48. The device of FIG. 3 is used in the same way as device 10 of FIGS. 1 and 2.

I claim:

1. A control device in the nature of a joy stick switch comprising: a base plate having an opening therethrough; a shaft extending through the opening and having a ball joint intermediate its ends for pivotally mounting the shaft on the base plate for movement in any direction throughout a 360° arc from an equilibrium position to an operative position and return; a number of switches secured to the base plate in an array in surrounding relationship to said opening, each switch having an actuator element shiftably mounted thereon for actuating the same; a rigid strip for each switch, respectively, each strip being pivotally mounted on said base plate for movement in a limited distance in opposed directions to shift the actuator element of the corresponding switch as a function of the pivotal movement of the shaft away from said equilibrium position relative to the base plate in a predetermined direction; a stop for each strip, respectively, the stops being secured to and extending laterally from the base plate; and means biasing each strip against the corresponding stop.

2. A control device as set forth in claim 1, wherein each strip has a pair of opposed ends, there being a bracket secured to one end of each strip, respectively, and a pivot pin rigidly secured to and projecting outwardly from said base plate, there being a pivot pin for each strip, respectively, the bracket of each strip being pivotally mounted on the corresponding pivot pin.

3. A control device as set forth in claim 1, wherein the shaft has a boss thereon adjacent to the switches, each strip being in proximity to the boss.

4. A control device as set forth in claim 1, wherein each switch has a housing and a spring in the housing for biasing the corresponding actuator element outwardly of the housing, the spring defining said bias means.

5. A control device as set forth in claim 1, wherein said bias means includes a coil spring for each strip, respectively, one end of each strip spring being secured to the base plate and the opposite end of the spring being connected to the respective strip, each spring being under tension.

6. A control device in the nature of a joy stick switch comprising: a base plate having an opening therethrough; a shaft extending through the opening and having a ball joint intermediate its ends for pivotally mounting the shaft of the base plate for movement in any direction throughout a 360° arc from an equilibrium position to an operative position and return; a number of switches secured to the base plate in an array in surrounding relationship to said opening, each switch having an actuator element shiftably mounted thereon for actuating the same; a rigid strip for each switch, respectively, each strip being pivotally mounted on the base plate for pivotal movement about an axis generally parallel with the shaft when the latter is in said equilibrium position, each strip being operable for shifting the actuator element of the corresponding switch as a function of the pivotal movement of the shaft away from said equilibrium position relative to the base plate in a predetermined direction; a coil spring for each strip, respectively, one end of each strip spring being secured to the base plate and the opposite end of the spring being connected to the respective strip, each spring being under tension, said shaft having a boss thereon adjacent to the switches; and a stop pin for each strip, respectively, the stop pins being secured to and projecting outwardly from the base plate, the strips being in engagement with respective stop pins and in proximity to the boss on the shaft when the shaft is in its equilibrium position.

7. In a control device for operating a number of actuatable devices: a base plate having an opening therethrough; a shaft extending through the opening and having a ball joint intermediate its end for pivotally mounting the shaft on the base plate for movement in any direction throughout a 360° arc from an equilibrium position to an operative position and return, said base plate having surface portions permitting said actuatable devices to be secured to the base plate in an array in surrounding relationship to said opening; a rigid strip for each actuatable device, respectively, each strip being pivotally mounted on said base plate for movement through a limited distance in opposed directions and into and out of actuating relationship to a corresponding actuatable device as a function of the pivotal movement of the shaft away from said equilibrium position relative to the base plate in a predetermined direction when said corresponding actuatable device is secured to the base plate; a stop for each strip, respectively, the stops being secured to and extending laterally from the base plate; and means biasing each strip against the corresponding stop.

8. A control device as set forth in claim 7, wherein each strip has a pair of opposed ends, there being a bracket secured to one end of each strip, respectively, and a pivot pin rigidly secured to and projecting outwardly from said base plate, there being a pivot pin for each strip, respectively, the bracket of each strip being pivotally mounted on the corresponding pivot pin.

9. A control device as set forth in claim 7, wherein the shaft has a boss thereon, each strip being in proximity to the boss.

10. A control device as set forth in claim 9, wherein the boss has a cylindrical outer surface for engaging the strips.

11. A control device as set forth in claim 7, wherein said bias means includes a coil spring for each strip, respectively, one end of each strip spring being secured to the base plate and the opposite end of the spring being connected to the respective strip, each spring being under tension.

* * * * *